United States Patent [19]

Thimander

[11] 4,362,119

[45] Dec. 7, 1982

[54] ANCHOR HOIST

[76] Inventor: Bengt Thimander, Vällingbyvägen 152, 162 21 Vällingby, Sweden

[21] Appl. No.: 235,790

[22] Filed: Feb. 19, 1981

[30] Foreign Application Priority Data

Feb. 21, 1980 [SE] Sweden ..... 8001382

[51] Int. Cl.[3] ..... B63B 21/22

[52] U.S. Cl. ..... 114/210; 114/218; 114/364

[58] Field of Search ..... 248/214, 230; 114/294, 114/364, 293, 210, 270, 218, 199; 9/1.7

[56] References Cited

U.S. PATENT DOCUMENTS

| | | | |
|---|---|---|---|
| 3,071,097 | 1/1963 | Dowrelio | 114/210 |
| 3,626,888 | 12/1971 | Cameron | 114/210 |
| 3,812,811 | 5/1974 | Rodriguez | 114/218 |
| 3,940,412 | 6/1960 | Whitney | 114/210 |
| 3,991,699 | 11/1976 | Bass | 114/210 |

*Primary Examiner*—Trygve M. Blix
*Assistant Examiner*—D. W. Keen
*Attorney, Agent, or Firm*—Sughrue, Mion, Zinn, Macpeak & Seas

[57] ABSTRACT

An anchor hoist comprises a main body member having two side walls. The main body member is pivotally mounted to a pivot-forming boat fixture and has an inner and an outer rotatable sheave for receiving an anchor line or chain. The center-to-center distance between the rotary axes of the sheaves is greater than four times the diameter of the inner sheave, and is in practice about 50 cm. Arranged in the region of the outer end of the main body member is a pivotable support device which, in the in-use position of the hoist, engages a lower, further boat fixture. Pivotally mounted on the axis of the inner sheave is a line holder, e.g. in the form of a clam cleat, so arranged that when the anchor line is jerked said cleat will swing inwardly-outwardly to release the anchor. When using the anchor hoist of this invention, the anchor will be located at a distance from the side of the boat such as to avoid contact between the anchor and the side of the boat when the anchor is lifted or slipped.

5 Claims, 3 Drawing Figures

ANCHOR HOIST

Figure 1:
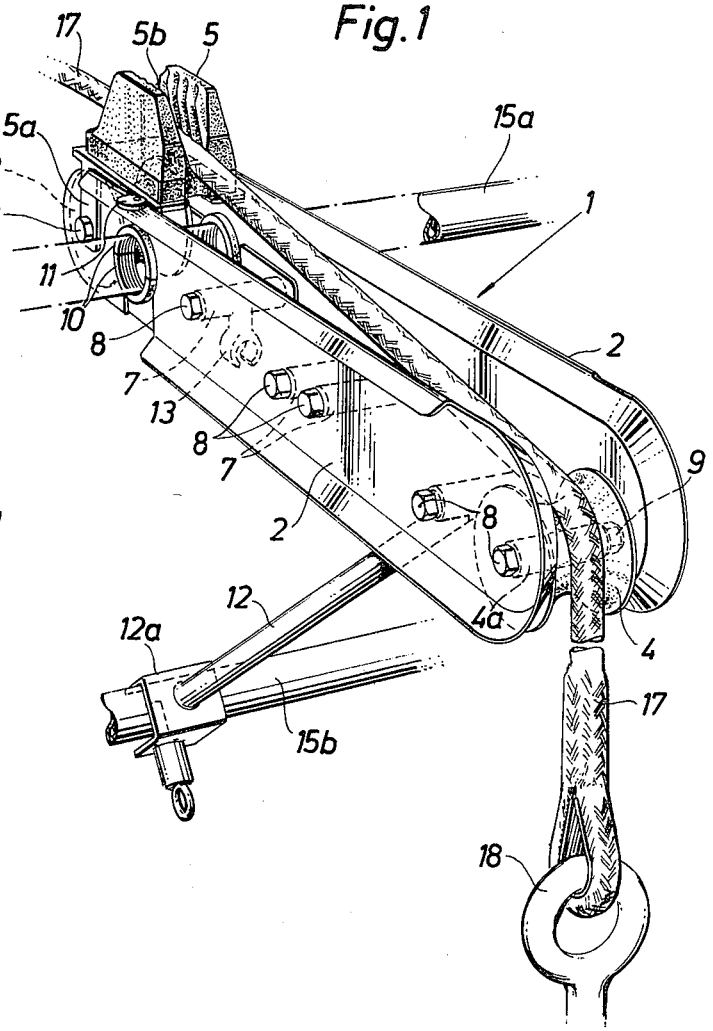

The present invention relates to an anchor hoist comprising a main body member having two side walls between which first and second sheaves or pulleys are arranged in spaced relationship for receiving an anchor line or chain, and in which the main body member is provided with means for pivotally connecting said main body member to a fixture on the boat in which the anchor hoist is used.

Such anchor hoists are found described and illustrated, for example, in U.S. Pat. Nos. 2,940,412 and 3,071,097.

In the known anchor hoist the side walls of the main body member are joined together by intermediate, tubular distance elements through which bolts are passed and anchored by means of nuts on the outside of one side wall.

To permit the anchor hoist to be pivotally journalled to said fixture, which may have the form of a pulpit or like element, the side walls are provided at one end thereof with two pivotable elements provided with partly semi-circular recesses, so that a bush, for example made of Teflon and comprising two halves, can be placed in respective recesses. When the two pivotable parts of the side wall are then assembled around the pulpit or like fixture and locked to said pulpit, the pulpit will form a shaft accommodated in the bushes in the main body member around which the anchor hoist can swing.

Further, in the known anchor hoists the two sheaves or pulleys are located relatively close together, which presents a comparatively serious disadvantage when the anchor chain or line extends vertically downwardly at a small distance from the side of the boat, since there is a serious risk of the anchor striking the side of the boat as the anchor is lifted, resulting in damage to the boat. This is particularly true when the anchor is lifted in a heavy swell, causing the boat to rock and the anchor line to swing.

An object of the present invention is to provide an improved anchor hoist with which the aforementioned disadvantage is at least substantially eliminated.

A further object of the invention is to provide an improved anchor hoist of the aforedescribed kind in which the anchor line or chain can be released simply by jerking said line from a location inwardly of the boat.

Another object of the invention is to provide an anchor hoist which can be readily adjusted between a non-operative or transport position and an active extended position for use when desiring to drop or to raise the anchor.

In its widest aspect an anchor hoist according to the invention is mainly characterized in that the main body member has a length such that the distance between the journalling axis of the main body member on said fixture and the axis of the outer sheave is at least three, preferably least four times the diameter of the inner sheave; and in that in the region of its outer end the main body member has a pivotal support means arranged to engage a fixed part of the boat, e.g. a lower pulpit, a leg support or like element, in the in-use position of the anchor hoist.

In an anchor hoist according to the invention, the outer sheave is located at a relatively large distance from the pivot-forming fixture, thereby greatly reducing the risk of the anchor striking the side of the boat as the anchor is lifted. Moreover, the adjustable support contributes in taking up the increased torque on the inner bearing shaft of the anchor hoist, and will therewith substantially stiffen and strengthen the anchor hoist in its in-use position, thereby increasing the reliability and sureness of the hoist as a whole.

There is preferably arranged at the inner end of the main body member a line-holding device, e.g. a clam cleat, which is pivotally mounted on the main body member so that when the anchor line is jerked the line holder will swing inwardly and downwardly, therewith to release said line.

The line holder or cleat will thus co-act with the outer sheave of the hoist in a manner such as to enable the anchor to be prepared for slipping in good time, so that when the anchorage site is reached all that is necessary is a simple pull on the line, for example from within the cockpit of the boat, without risk of damaging the side of the boat when the anchor is dropped.

In accordance with one embodiment of the invention, the pivot axis of the cleat coincides with the rotary axis of the inner sheave. In this case, the line-holder or cleat is suitably provided on both sides thereof with an arm or a pin whose length exceeds the radius of the inner sheave, such that the sheave during an anchor dropping operation will swing inwardly—downwardly at a safe distance from the inner sheave.

It is also possible, however, by means of a separate catch device to lock the sheave in its line-holding position. The catch means may be used, for example, when wishing to raise the anchor in stages, e.g. when conditions on the sea-bed are difficult, and where it is desired to clamp the anchor line between each lifting step.

To facilitate this latter operation there may be provided between the pivot shaft of the main body member and the outer sheave a take-up shaft for a lever arrangement which is detachable from the main body member and which is arranged to co-act with the line-holder for lifting the anchor.

The lever arrangement may, for example, have at its lower end a U-shaped element arranged to engage around said take-up shaft, which thus serves as a pivot shaft for said lever arrangement.

When the anchor hoist is not in use, it is swung inwardly around the pivot-forming fixture to an approximate vertical or slightly inclined storage position. Prior to swinging in the anchor hoist, the pivotable support is released from its engagement with the boat fixture. For the purpose of holding the pivotable support in its collapsed storage position, the main body member may be provided with holding means for engagement with said pivotable support.

Figure 3:
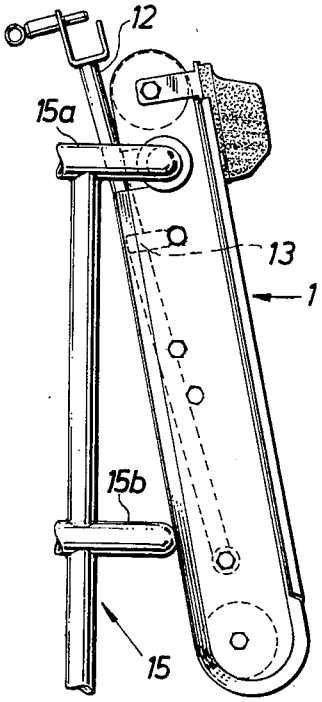
Figure 2:
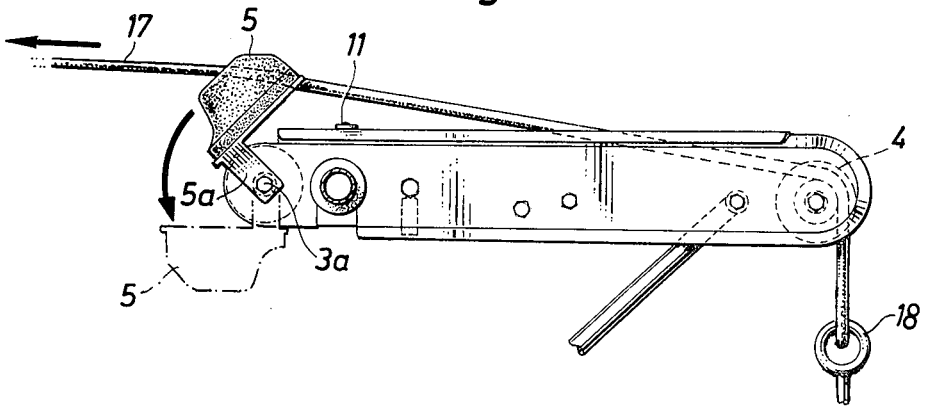

An exemplary embodiment of the invention will now be described in more detail with reference to the accompanying schematic drawing, in which FIG. 1 is a perspective view of an anchor hoist according to the invention, with an anchor line being lockingly engaged in a pivotable clam cleat, FIG. 2 is a side view of the anchor hoist illustrated in FIG. 1 with the cleat swung upwardly to an anchor-line release position, and FIG. 3 is a side view of the anchor hoist in its downwardly swung non-operative or transport position.

The anchor hoist illustrated in the drawing is generally referenced 1 and comprises a main body member having two mutually parallel side walls 2 between which an inner sheave or pulley 3 and an outer sheave or pulley 4 are rotatably journalled and arranged to accommodate an anchor line or chain 17 in the in-use position of the hoist.

The sheaves 3 and 4 may comprise Delrin or a material having similar properties. Arranged between the side walls 2 is a number of spacers comprising hollow stubs 7 through which bolts 8 are passed and secured on the outside of one side wall by means of nuts 9. The end portions of the two side walls comprise two recessed parts, and one such spacer 7,8,9 serves to fix said end parts in a manner such that the two recessed parts engage around a bearing sleeve 10 made of Delrin and comprising two parts.

When assembling the anchor hoist, the said two-part bearing sleeve accommodates a part 15*a* of a boat fixture, such as a pulpit 15, whereafter the two side walls are assembled and secured by means of adjacent spacers 7,8,9.

A line holder having the form of a clam cleat 5 is pivotally arranged on the shaft 3*a* of the inner sheave 3 by means of an arm 5*a* whose length is greater than the radius of the inner sheave 3. The cleat 5 has a central groove 5*b* for accommodating the anchor line 17 and extending parallel with the side walls, the mutually opposite inner surfaces of the groove having trough-like parts arranged to engage the anchor line in a manner to enable it to be releaseably held by the cleat.

The distance between the centres of the rotary axes 3*a* and 4*a* of the inner and outer sheaves 3 and 4 respectively is preferably four times greater than the diameter of the inner sheave 3, which in practice means that said distance should be at least 35 cm. In many cases it is preferred that this distance is at least 50 cm, so as to avoid the anchor striking and damaging the side of the boat.

The anchor hoist is also provided with a pivotable support device 12 which is journalled slightly inwardly of the rotary axis 4*a* of the outer sheave 4. The support device 12 may have a length which approximately corresponds to the length of the side walls, which means that when the support occupies its inwardly swung or collapsed position, in which it extends substantially parallel with the side walls, it projects slightly beyond the inner sheave 3.

The support 12 of the illustrated embodiment has at one end thereof a U-shaped bracket structure 12*a* which in the in-use position of the hoist, as shown in FIGS. 1 and 2, engages a fixed part of the boat, which in the illustrated embodiment comprises a lower pulpit 15*b*. Alternatively, the support may engage some other fitting (not shown), a leg support (not shown) or like element.

When the anchor hoist is to be used, it is swung to a substantially horizontal position, as shown in FIGS. 1 and 2, and the bracket structure 12*a* at the support 12 is engaged around the boat fixture 15*b*. As the boat approaches harbour for example, the anchor line 17 is placed over the outer sheave 4 and is fixed in the cleat 5, as shown in FIG. 1. The anchor then hangs in readiness over the side of the boat beneath the anchor hoist via an anchor ring 18.

When the anchor is to be slipped, the anchor line 17 is jerked, e.g. from the cockpit of the boat, whereat the cleat 5 is swung upwardly to the position shown in FIG. 2, and the line is automatically released from the cleat causing the anchor to drop. As will be understood the anchor release operation, i.e. the jerk on the anchor line, can be carried out at a considerable distance from the anchor hoist, e.g. from the cockpit of the boat.

When the anchor is to be lifted, the anchor line is placed over the two sheaves 4 and 3, and the line pulled in, for example from said cockpit. When lifting the anchor, the cleat can be swung to one side so as not to take part in the lifting operation. Alternatively, the cleat 5 can be used for lifting the anchor in stages, said line being held in the cleat between said lifting stage. Such a lifting operation can also be carried out with the aid of a separate, detachable lever (not shown), one end of which is arranged to be inserted in a selected one of said spacers which then serves as a journalling or take-up shaft for said lever. Such a lever facilitates the work of lifting the anchor, and the anchor line is held in the cleat each time the lever is moved forwards with the line stationary over the sheaves. In this case it is important that the sheave 5 remains in its active position, to which end there is provided a separate catch means 11 arranged to hold the cleat fast.

FIG. 3 illustrates the anchor hoist in its non-operative or transport position, in which the main body member is swung down to an approximate vertical position in abutment with the lower pulpit 15*b*. In this position of the hoist the support 12 is swung inwardly and is held in said inwardly swung position by means of a U-shaped holding device 13. Alternatively, in its non-operative or transport position the hoist may be swung inwardly in a manner such that the main body member of the hoist is located within the pulpits 15*a*, 15*b*.

What is claimed is:

1. An anchor hoist comprising:

a main body comprising two parallel side wall members, said main body being pivotally mounted on a pivot-forming boat fixture;

an inner sheave and an outer sheave for receiving an anchor line, said inner and outer rotatable sheave being rotatably mounted between said two side wall members of said main body, a distance between a pivoting axis of said main body upon said pivot-forming boat fixture and a rotary axis of said outer sheave being at least three times the diameter of said inner sheave;

a pivotable support device arranged on said main body in the region of an outer end thereof adjacent said outer sheave, said pivotable support device having means for engaging a further boat fixture in an in-use position of said hoist; and a line-holding device rotatably mounted on an inner end of said main body member and having a rotary axis coinciding with said rotary axis of said main body member on said pivot-forming boat structure, said line-holding device being arranged to swing inwardly and downwardly when said anchor line is jerked inwardly of the boat so as to release said anchor line.

2. A anchor hoist according to claim 1, in which latch means are provided for latching the line holding device in its line holding position.

3. An anchor hoist according to claim 1, in which the main body member is provided with holding means for holding the pivotable support in its inoperative position and in the non-operative position of the hoist.

4. An anchor hoist according to claim 1, in which the length of the support means corresponds approximately to the length of the side walls.

5. The anchor hoist of claim 1 wherein said distance between said rotary axis of said main body on said pivot-forming structure and said rotary axis of said outer sheave is at least four times said diameter of said inner sheave.

* * * * *